US011225970B2

(12) United States Patent
Lee et al.

(10) Patent No.: US 11,225,970 B2
(45) Date of Patent: Jan. 18, 2022

(54) ROTARY COMPRESSOR WITH VANE SLOT DISPOSED AT PREDETERMINED TILTING ANGLE

(71) Applicant: LG ELECTRONICS INC., Seoul (KR)

(72) Inventors: Jingyu Lee, Seoul (KR); Shin Kim, Seoul (KR); Kyuchul Han, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/838,227

(22) Filed: Apr. 2, 2020

(65) Prior Publication Data

US 2020/0370549 A1 Nov. 26, 2020

(30) Foreign Application Priority Data

May 24, 2019 (KR) ..... 10-2019-0061409

(51) Int. Cl.
*F04C 18/324* (2006.01)
*F04C 2/00* (2006.01)
(Continued)

(52) U.S. Cl.
CPC ..... *F04C 18/324* (2013.01); *F01C 21/102* (2013.01); *F04C 2/00* (2013.01);
(Continued)

(58) Field of Classification Search
CPC ..... F01C 1/324; F04C 2/324; F04C 18/324
See application file for complete search history.

(56) References Cited

U.S. PATENT DOCUMENTS

2017/0275996 A1 9/2017 Cho et al.

FOREIGN PATENT DOCUMENTS

CN 203412766 U * 1/2014
CN 111287961 A * 6/2020
(Continued)

OTHER PUBLICATIONS

Korean Office Action dated Jul. 14, 2020 issued in KR Application No. 10-2019-0061409.
(Continued)

*Primary Examiner* — Laert Dounis
(74) *Attorney, Agent, or Firm* — Ked & Associates LLP

(57) ABSTRACT

A rotary compressor may include a rotary shaft; a plurality of plates that supports the rotary shaft; a cylinder provided between the plurality of plates to define a compression space, and provided with a vane slot; a roller slidably coupled to the rotary shaft inside of the cylinder, and having a hinge groove on an outer circumferential surface of the roller; and a vane, a first end of which is slidably coupled to the vane slot of the cylinder, and a second end of which is rotatably coupled to the hinge groove of the roller. When an imaginary line passing through an axial center of the rotary shaft and a hinge center of the vane is a first center line, and a radial center line of the vane slot passing through the hinge center of the vane is a second center line, the vane slot is disposed such that the second center line is intersected by a predetermined tilting angle with respect to the first center line. With this structure, a roller reaction force is canceled to suppress an increase in side pressure or side wear between a vane and a vane slot into which the vane is inserted.

18 Claims, 10 Drawing Sheets

(51) Int. Cl.
*F01C 21/10* (2006.01)
*F04C 18/356* (2006.01)

(52) U.S. Cl.
CPC ..... *F04C 18/356* (2013.01); *F04C 2210/26* (2013.01); *F04C 2240/60* (2013.01); *F04C 2240/80* (2013.01); *F04C 2270/16* (2013.01)

(56) References Cited

FOREIGN PATENT DOCUMENTS

| | | | | | |
|---|---|---|---|---|---|
| DE | 362425 | C | * | 10/1922 | ..... F01C 1/324 |
| FR | 436267 | A | * | 3/1912 | ..... F01C 1/324 |
| JP | 07174088 | A | * | 7/1995 | |
| JP | 09-137785 | | | 5/1997 | |
| JP | 09137785 | A | * | 5/1997 | |
| JP | 10259786 | A | * | 9/1998 | |
| JP | 2001-221179 | | | 8/2001 | |
| JP | 2010-168977 | | | 8/2010 | |
| JP | 2011-052592 | | | 3/2011 | |
| KR | 19990034729 | A | * | 5/1999 | |
| KR | 20100000369 | A | * | 1/2010 | |
| KR | 10-2013-0117982 | | | 10/2013 | |
| KR | 10-2016-0034071 | | | 3/2016 | |
| WO | WO 2016/043439 | | | 3/2016 | |

OTHER PUBLICATIONS

European Search Report dated Jul. 29, 2020 issued in EP Application No. 20168861.1.

* cited by examiner

ROTARY COMPRESSOR WITH VANE SLOT DISPOSED AT PREDETERMINED TILTING ANGLE

CROSS-REFERENCE TO RELATED APPLICATION(S)

Pursuant to 35 U.S.C. § 119(a), this application claims the benefit of an earlier filing date of and the right of priority to Korean Patent Application No. 10-2019-0061409, filed in Korea on May 24, 2019, the contents of which are incorporated by reference herein in its entirety.

BACKGROUND

1. Field

A rotary compressor, and more particularly, a rotary compressor in which a roller and a vane are coupled to each other are disclosed herein.

2. Background

A rotary compressor compresses refrigerant using a roller performing an orbiting movement in a compression space of a cylinder and a vane in contact with an outer circumferential surface of the roller to partition the compression space of the cylinder into a plurality of spaces. The rotary compressor may be divided into a rolling piston type and a hinge vane type according to whether the roller and the vane are coupled to each other. The rolling piston type is a type in which the vane is detachably coupled to the roller so that the vane is closely attached to the roller, and the hinge vane type is a type in which the vane is hinge-coupled to the roller. JP2010-168977A (hereinafter "Patent Document 1") and KR1020160034071A (hereinafter "Patent Document 2" each discloses a hinge vane type, the hinge vane type having a stable vane behavior compared to the rolling piston type, thereby reducing axial leakage.

The rotary compressor generates a gas force in a compression space during a compression process, and the vane receives a force in a width direction by the gas force. However, as a rear side of the vane is coupled to a vane slot, the vane transmits a force in the width direction to the vane slot of the cylinder. Then, cylinder reaction forces acting in opposite directions while being orthogonal to the vane slot are generated on inner and outer circumferential sides of the vane slot. This pair of cylinder reaction forces act as a couple of forces as they are generated at predetermined intervals in a length direction of the vane. Therefore, when the vane reciprocates, a side surface of the vane and a sidewall surface of the vane slot may be pressed against each other to cause side wear while increasing side pressure.

Such increase in side pressure or side wear may be greater in the hinge vane type as in Patent Document 1 and Patent Document 2 than in the rolling piston type. In other words, in the rotary compressor, a roller reaction force is generated by a compression force generated during the compression process. The roller reaction force is canceled as the roller rotates in the rolling piston type, whereas the roller reaction force is not canceled but transmitted to the vane as the vane is coupled and constrained to the roller in the hinge vane type. As a result, in the hinge vane type, a resultant force of the roller reaction force and the gas force acts on the vane, and the resultant force further presses between a side surface of the vane and an edge of the vane slot to increase side pressure or increase side wear, thereby reducing compressor efficiency.

BRIEF DESCRIPTION OF THE DRAWINGS

Embodiments will be described in detail with reference to the following drawings in which like reference numerals refer to like elements, and wherein:

FIG. 5A shows an example in which the vane slot in the related art is applied, and FIG. 5B shows an example in which the vane slot according to an embodiment is applied;

FIG. 11 shows an embodiment in which the wear avoiding portion is disposed, and FIG. 12 shows an embodiment in which the dimple portion is disposed.

DETAILED DESCRIPTION

Hereinafter, a rotary compressor according to embodiments will be described with reference to the accompanying drawings. The rotary compressor according to embodiments may be classified as a single rotary compressor or a double rotary compressor according to a number of cylinders. The embodiments relate to an axial side shape of a roller or a plate facing the roller in a hinged vane type rotary compressor in which the roller and a vane are coupled. Therefore, the embodiments may be applied to both a single rotary compressor or a double rotary compressor. Hereinafter, a single rotary compressor will be described as an example, but the same description may also be applicable to a double rotary compressor.

Figure 1:
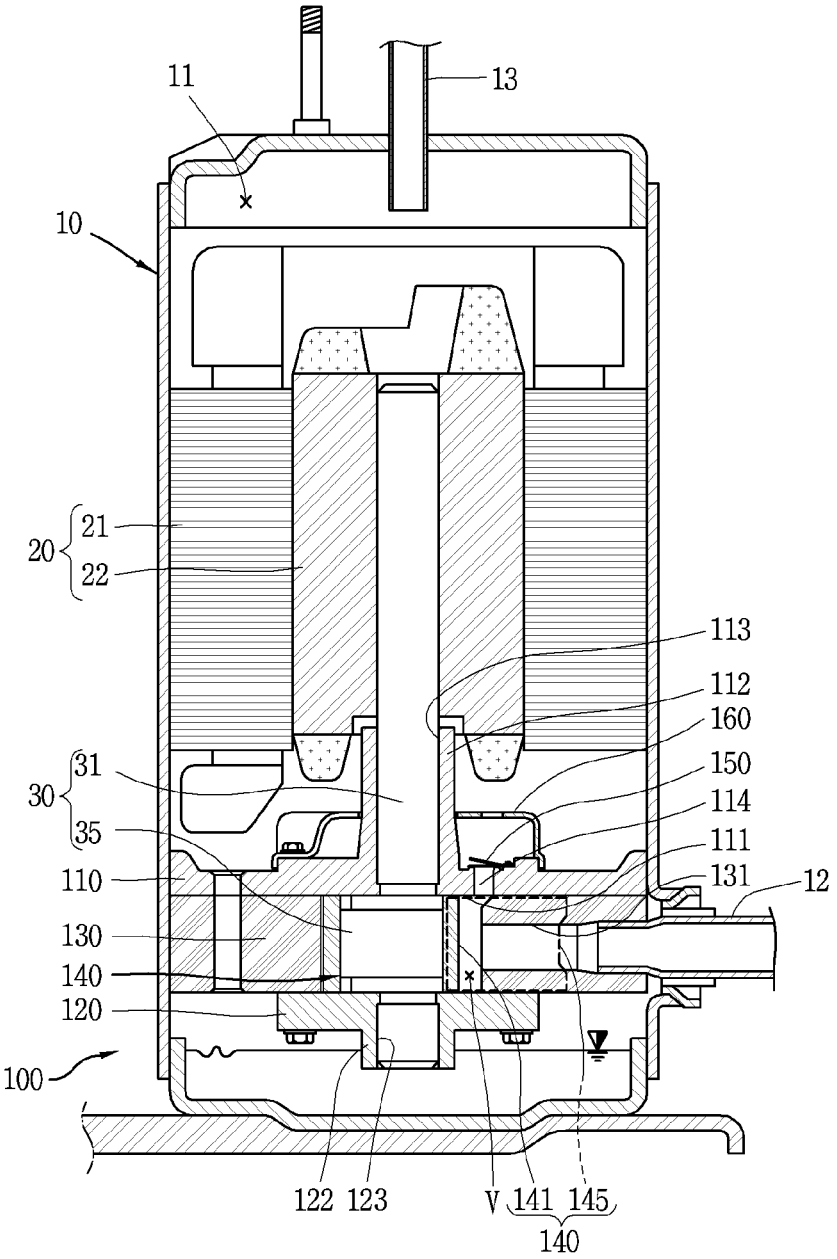
FIG. 1 is a longitudinal cross-sectional view showing a rotary compressor according to an embodiment.
Figure 2:
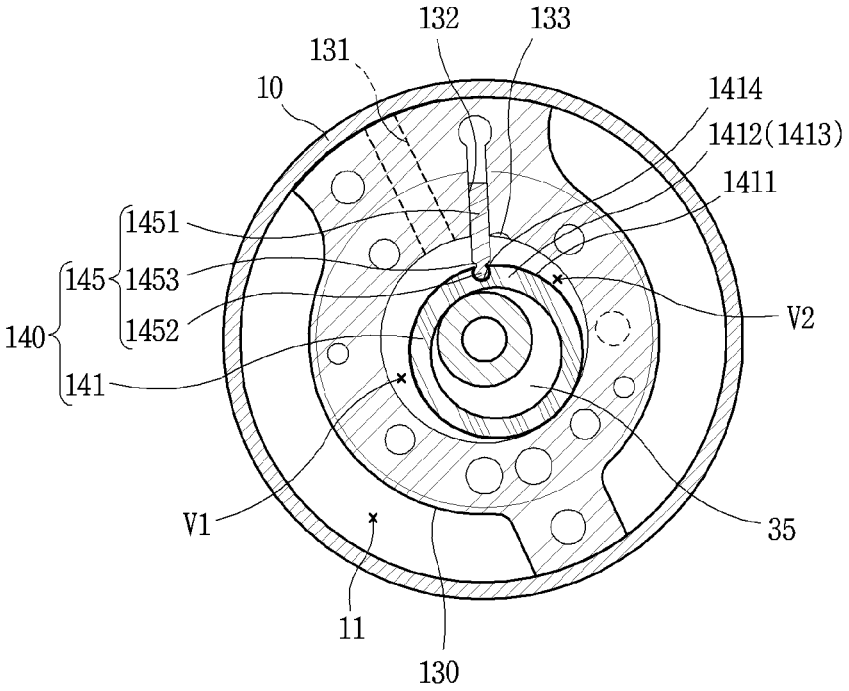
FIG. 2 is a transverse cross-sectional view showing a compression unit in the rotary compressor according to FIG. 1.

FIG. 1 is a longitudinal cross-sectional view showing a rotary compressor according to an embodiment. FIG. 2 is a transverse cross-sectional view showing a compression unit in the rotary compressor according to FIG. 1.

Referring to FIGS. 1 and 2, in the rotary compressor according to an embodiment, an electric motor unit or electric motor 20 may be provided in an inner space 11 of a casing 10, and a compression unit 100 mechanically connected by a rotary shaft 30 may be provided in the inner space 11 of the casing 10 at a lower side of the electric motor unit 20.

The electric motor unit 20 may include a stator 21, for example, press-fitted and fixed to an inner circumferential surface of the casing 10 and a rotor 22 rotatably inserted into the stator 21. The rotary shaft 30 may be press-fitted and coupled to the rotor 22. An eccentric portion 35 is disposed eccentrically with respect to a shaft portion 31 in the rotary shaft 30, and a roller 141 of a vane roller 140, which will be described hereinafter, may be slidably coupled to the eccentric portion 35.

The compression unit 100 may include a main plate 110, a sub plate 120, a cylinder 130, and a vane roller 140. The main plate 110 and the sub plate 120 may be provided at both axial sides with the cylinder 130 interposed therebetween to define a compression space (V) inside of the cylinder 130. In addition, the main plate 110 and the sub plate 120 support the rotary shaft 30 passing through the cylinder 130 in a radial direction. The vane roller 140 may be coupled to the eccentric portion 35 of the rotary shaft 30 to compress refrigerant while performing an orbiting movement in the cylinder 130.

The main plate 110 may be defined in a disk shape, and side wall portion or side wall 111 may be, for example, shrink-fitted or welded to an inner circumferential surface of the casing 10 at an edge thereof. A main shaft receiving portion 112 may be disposed at a center of the main plate 110 to protrude upward, and a main shaft receiving hole 113 may be disposed at the main shaft receiving portion 112 to pass therethrough such that the rotary shaft 30 is inserted and supported thereto.

A discharge port 114 in communication with the compression space (V) to discharge refrigerant compressed in the compression space (V) to the inner space 11 of the casing 10 may be disposed at one side of the main shaft receiving portion 112. In some cases, the discharge port may be disposed in the sub plate 120 instead of the main plate 110.

The sub plate 120 may be defined in a disc shape and bolt-fastened, for example, to the main plate 110 together with the cylinder 130. Of course, when the cylinder 130 is fixed to the casing 10, the main plate 110 may be bolt-fastened, for example, to the cylinder 130 and the sub plate 120, respectively, and when the sub plate 120 fixed to the casing 10, the cylinder 130 and the main plate 110 may be bolt-fastened to the sub plate 120.

A sub shaft receiving portion 122 may be disposed at a center of the sub plate 120 to protrude downward, and a sub shaft receiving hole 123 may be disposed at the sub shaft receiving portion 122 to pass therethrough on a same axial line as the main shaft receiving hole 113. A lower end of the rotary shaft 30 may be supported by the sub shaft receiving hole 123.

The cylinder 130 may be formed in a circular annular shape with a same inner diameter on an inner circumferential surface thereof. An inner diameter of the cylinder 130 may be larger than an outer diameter of the roller 141 to define the compression space (V) between an inner circumferential surface of the cylinder 130 and an outer circumferential surface of the roller 141. Accordingly, the inner circumferential surface of the cylinder 130, the outer circumferential surface of the roller 141, and the vane 145 may define an outer wall surface of the compression space (V), an inner wall surface of the compression space (V), and a side wall surface of the compression space (V), respectively. Therefore, as the roller 141 performs an orbiting movement, the outer wall surface of the compression space (V) may define a fixed wall while the inner wall surface and the side wall surface of the compression space (V) define a variable wall whose position is variable.

A suction port 131 may be disposed in the cylinder 130, a vane slot 132 may be disposed at one circumferential side of the suction port 131, and a discharge guide groove 133 may be disposed at an opposite side of the suction port 131 with the vane slot 132 interposed therebetween. The suction port 131 may pass therethrough in a radial direction, and be connected to a suction pipe 12 passing through the casing 10. Accordingly, refrigerant may be suctioned into the compression space (V) of the cylinder 130 through the suction pipe 12 and the suction port 131.

The vane slot 132 may be defined in an elongated manner on an inner circumferential surface of the cylinder 130 in a direction toward an outer circumferential surface thereof. An inner circumferential side of the vane slot 132 is open, and an outer circumferential side thereof is closed. The vane slot 132 may have a width approximately equal to a thickness or width of the vane 145 to allow the vane 145 of the vane roller 140, which will be hereinafter, to slide therein. Accordingly, side surfaces of the vane 145 are supported by inner wall surfaces of the vane slot 132 to slide approximately linearly. The vane slot will be explained hereinafter.

The discharge guide groove 133 may be defined in a chamfered shape at an inner edge of the cylinder 130. The discharge guide groove 133 may serve to guide refrigerant compressed in the compression space of the cylinder to the discharge port 114 of the main plate 110. However, as the discharge guide groove 133 generates dead volume, the discharge guide groove should not be provided unless necessary, and if the discharge guide groove is provided, a volume thereof should be kept to a minimum.

The vane roller 140 may include a roller 141 and a vane 145 as described above. The roller 141 and the vane may be a single body or may be coupled to each other to allow relative movement. The embodiment will be described based on an example in which the roller and the vane are rotatably coupled to each other.

The roller 141 may include a roller body 1411, a sealing surface 1412, 1413, and a hinge groove 1414. The roller body 1411 may be defined in a cylindrical shape. An axial height of the roller body 1411 may be approximately equal to an inner circumferential height of the cylinder 130. However, as the roller 141 must slide relative to the main plate 110 and the sub plate 120, the axial height of the roller body 1411 may be slightly smaller than the inner circumferential height of the cylinder 130.

Further, the inner circumferential height and an outer circumferential height of the roller body 1411 may be substantially the same. Accordingly, both axial cross-sections connecting the inner circumferential surface and the outer circumferential surface of the roller body 1411 define a first sealing surface 1412 and a second sealing surface 1413, and the first sealing surface 1412 and the second sealing surface 1413 are perpendicular to the inner or outer circumferential surface of the roller body 1411. However, an edge between an inner circumferential surface of the roller 141 and the sealing surfaces 1412, 1413 or an edge between an outer circumferential surface of the roller 141 and the sealing surfaces 1412, 1413 may be defined at a right angle or may be slightly inclined or curved.

The roller 141 may be rotatably inserted into and coupled to the eccentric portion 35 of the rotary shaft 30, and the vane 145 may be slidably coupled to the vane slot 132 of the cylinder 130 and hinge-coupled to an outer circumferential surface of the roller 141. Accordingly, the roller 141 may perform an orbiting movement inside of the cylinder 130 by the eccentric portion 35 during rotation of the rotary shaft 30, and the vane may reciprocate in a state of being coupled to the roller 141.

Hinge groove 1414 may be disposed on the outer circumferential surface of the roller body 1411 so that a hinge protrusion 1452 of the vane 145, which will be described hereinafter, may be inserted to rotate. The hinge groove 1414 will be described hereinafter.

The vane 145 may include a vane body 1451, hinge protrusion 1452, and an interference avoiding surface 1453. The vane body 1451 may be defined in a flat plate shape having a predetermined length and thickness. For example, the vane body 1451 may be defined in a rectangular hexagonal shape as a whole. In addition, the vane body 1451 may be defined by a length such that the vane 145 remains in the vane slot 132 even when the roller 141 is completely moved to an opposite side of the vane slot 132.

The hinge protrusion 1452 may extend to a front end portion of the vane body 1451 facing the roller 141. The hinge protrusion 1452 may be inserted into the hinge groove 1414 and have a rotatable cross-sectional area. The hinge protrusion 1452 may be defined in a substantially circular cross-sectional shape except for a semicircular or connecting portion to correspond to the hinge groove 1414.

The interference avoiding surface 1453 is a portion disposed to prevent the vane body 1451 from interfering with an axial edge of the hinge groove 1414 when the vane 145 rotates with respect to the roller 141. Accordingly, the interference avoiding surface 1453 may be disposed in a direction in which an area between the vane body 1451 and the hinge protrusion 1452 decreases. The interference avoiding surface 1453 may be defined in a wedge cross-sectional shape or in a curved cross-sectional shape, for example.

Reference numerals 150 and 152 on the drawing denote a discharge valve and a muffler, respectively, and 130 denotes a discharge pipe.

The foregoing rotary compressor according to an embodiment operates as follows.

When power is applied to the electric motor unit 20, the rotor 22 of the electric motor unit 20 is rotated to rotate the rotary shaft 30. Then, the roller 141 of the vane roller 140 coupled to the eccentric portion 35 of the rotary shaft 30 rotates to suction refrigerant into the compression space (V) of the cylinder 130. The refrigerant repeats a series of processes of being compressed by the roller 141 and the vane 145 of the vane roller 140 and discharged into the inner space 11 of the casing 10 through the discharge port 114 provided in the main plate 110.

At this time, positions of the roller and the vane move according to a rotational angle of the rotary shaft. FIGS. 3A-3F are schematic views showing a positional change of a vane roller with respect to a rotational angle of a rotary shaft in a rotary compressor according to an embodiment.

First, in this drawing, an imaginary line (hereinafter referred to as a "first center line") passing through an axial center (O) of the rotary shaft (the same as an axial center of the cylinder) and an axial center (O') of the hinge groove at a position where an eccentric portion of the rotary shaft faces the vane slot is referred to as 0°. This corresponds to FIG. 3A. At this time, the hinge groove of the roller is almost in contact with an inner circumferential surface of the cylinder so that the vane is drawn into the vane slot.

Figure 3A:
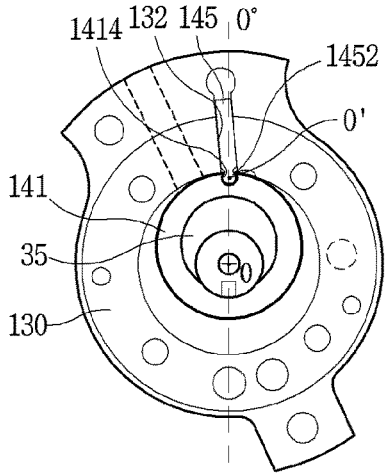
FIGS. 3A-3F are schematic views showing a positional change of a vane roller with respect to a rotational angle of a rotary shaft in a rotary compressor according to an embodiment.
Figure 3F:
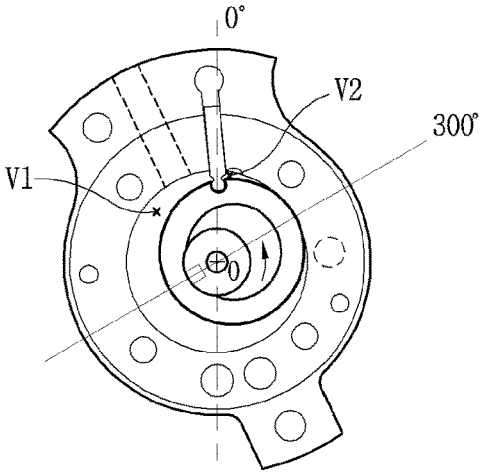
Figure 3B:
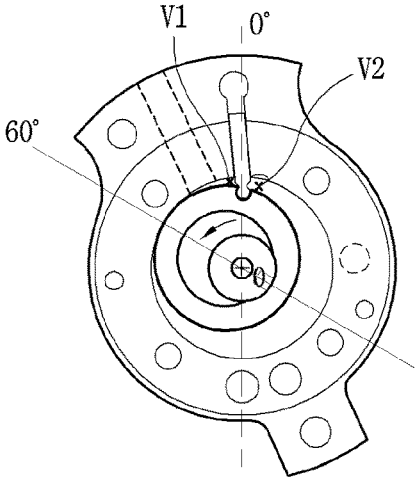
Figure 3E:
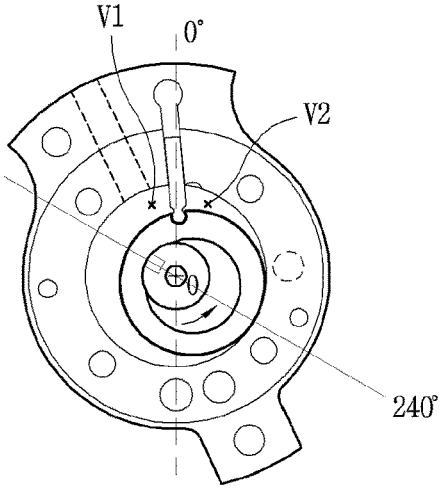
Figure 3C:
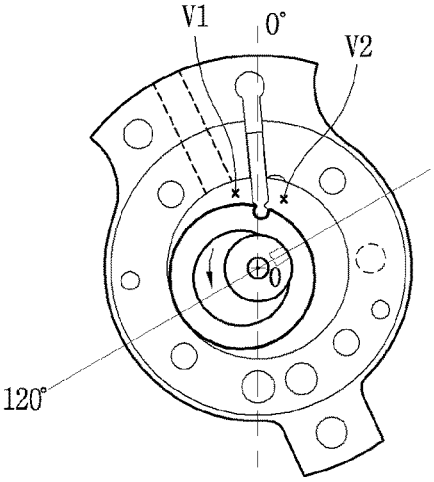

Next, FIGS. 3B and 3C show a state in which the rotary shaft is rotated about 60° and 120°. As a state in FIG. 3A is changed to states in FIGS. 3B and 3C, the hinge groove of the roller is spaced apart from an inner circumferential surface of the cylinder, and a portion of the vane is drawn out from the vane slot. At this time, a post-compression chamber (V2) forms a suction chamber while refrigerant flows into the post-compression chamber (V2) through the suction port. In contrast, a pre-compression chamber (V1) starts to compress refrigerant filled in the pre-compression chamber (V1) while forming the compression chamber. As refrigerant contained in the pre-compression chamber (V1) has not yet reached a discharge pressure, a gas force or vane reaction force is not generated or negligible in the pre-compression chamber (V1) even when generated.

Figure 3D:
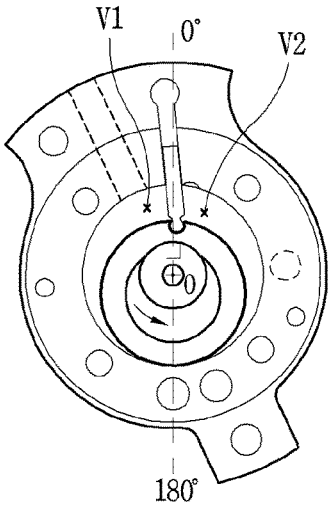

Next, FIG. 3D shows a state in which the rotary shaft is rotated about 180°. As a state in FIG. 3C is changed to a state in of FIG. 3D, the hinge groove of the roller is spaced apart from an inner circumferential surface of the cylinder to the maximum, and the vane is drawn out to the maximum from the vane slot. As the pre-compression chamber (V1) is in a state in which the compression stroke is substantially advanced, refrigerant contained in the pre-compression chamber (V1) is close to the discharge pressure. Then, in the pre-compression chamber (V1), a gas force and a roller reaction force are generated by refrigerant to be compressed, and the gas force and roller reaction force are transmitted to the vane. The reaction force is generated in a width direction of the vane between both sides of the vane and an inner surface of the vane slot by the gas force and the roller reaction force transmitted to the vane. This reaction force may cause an increase in side pressure or side wear between the vane and the vane slot. This will be described hereinafter along with an avoidance structure against an increase in side pressure or side wear.

Next, FIG. 3E illustrates a state in which the rotary shaft is rotated about 240 degrees. In this state, the hinge groove of the roller moves back toward an inner circumferential surface of the cylinder, and the vane is partially drawn into the vane slot. At this time, the refrigerant contained in the pre-compression chamber (V1) has already reached a discharge pressure to start discharging or has reached a discharge start point. Therefore, in this state, the gas force and the roller reaction force described above are at or near the maximum, and thus, an increase in side pressure or side wear between the vane or the vane slot may be generated to the greatest extent. This will be also described hereinafter along with an avoidance structure against an increase in side pressure or side wear.

Next, FIG. 3DF shows a state in which the rotary shaft is rotated about 300 degrees. In this state, refrigerant in the pre-compression chamber (V1) is almost discharged in which the hinge groove of the roller is almost in contact with an inner circumferential surface of the cylinder, and the vane is almost drawn into the vane slot. In this state, almost no refrigerant remains in the pre-compression chamber (V1), and thus, the gas force and roller reaction force are hardly generated.

As described above, in the rotary compressor, the gas force and roller reaction force act on the vane at the same time due to characteristics thereof. The gas force acts in a width direction of the vane, which is a direction from the pre-compression chamber (discharge chamber) to the post-compression chamber (suction chamber), and the roller reaction force acts in a direction toward the vane or acts as a component force to the force acting toward the vane depending on the position of the roller.

Accordingly, in the rotary compressor, as the gas force and roller reaction force are transmitted to a front side of the vane, a first reaction force and a second reaction force acting in opposite directions are generated between both side surfaces of the vane and around an inner circumferential edge and around an outer circumferential edge of the vane slot facing the both side surfaces of the vane. As a result, when the vane reciprocates inside the vane slot during the aforementioned compression process, both side surfaces of the vane and the side surface edges of the vane slots facing the vane are excessively in close contact with each other, thereby causing an increase in side pressure or side wear.

Thus, a side wear avoidance structure capable of reducing a reaction force acting between the vane and the vane slot facing the vane as in embodiments disclosed to suppress side wear between the vane and the vane slot may be provided.

Figure 4:
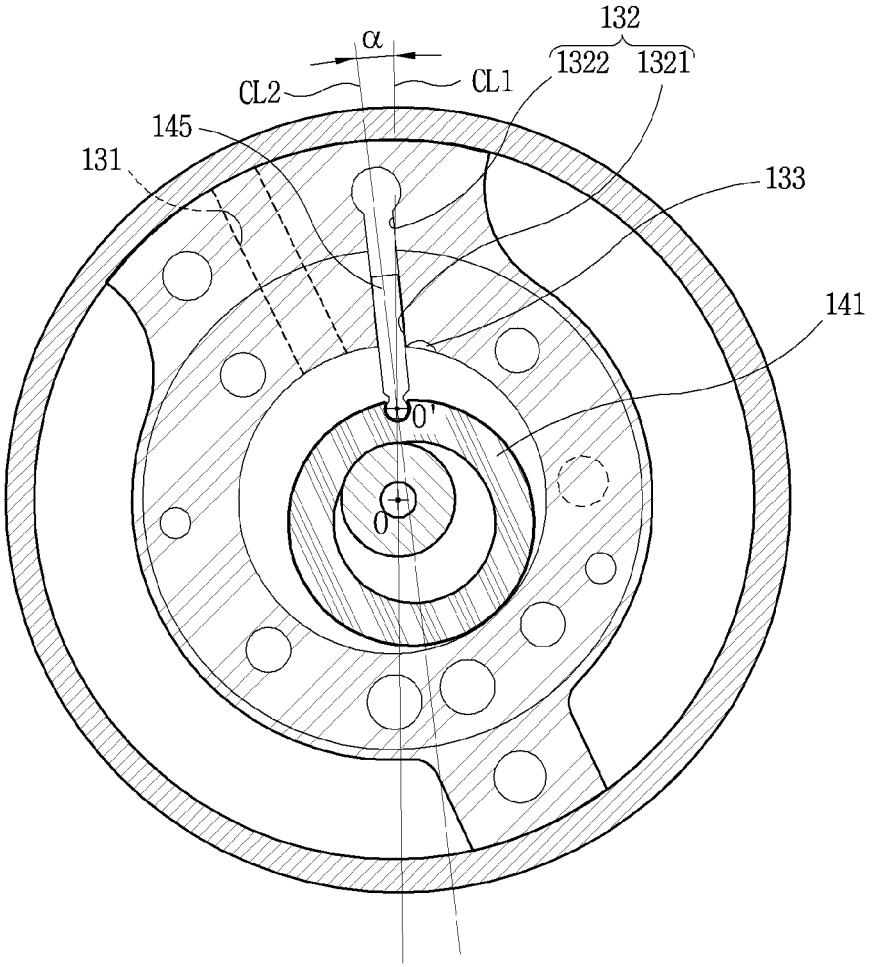
FIG. 4 is a transverse cross-sectional view showing a compression unit having a vane slot according to an embodiment.

FIG. 4 is a transverse cross-sectional view showing a compression unit having a vane slot according to an embodiment. Referring to FIG. 4, the cylinder 130 according to an embodiment may be defined in an annular shape having a circular shape with the same inner diameter on an inner circumferential surface thereof, and a vane slot 132 may be disposed between the suction port 131 and the discharge guide groove 133.

In addition, the vane 145 of the vane roller 140 may be slidably inserted into the vane slot 132. Accordingly, the vane slot 132 may be formed in a shape in which an inner circumferential side thereof is open toward the compression space (V), and an outer circumferential side thereof is closed. However, the outer circumferential side of the vane slot 132 may extend in an axial direction to communicate with the inner space 11 of the casing 10.

A width of the vane slot 132 may be slightly larger than a width of the vane 145. As a result, the vane 145 may be slid in the vane slot 132. In addition, an inner circumferential width of the vane slot 132 may be substantially the same as an outer circumferential width thereof. However, chamfered portions may also be disposed at end edges of an inner side wall surface of the vane slot 132 that diagonally face each other, respectively. In this case, a suction side of the chamfered portion may be disposed on an inner circumferential side wall surface, and a discharge side thereof may be disposed on an outer circumferential side wall surface. The chamfered portion may be disposed in an inclined or stepped manner.

In addition, the vane slot 132 may appear long in a radial direction in the drawing, but is not strictly in the radial direction. In other words, the vane slot 132 according to an embodiment may have a tilting angle ($\alpha$) by a predetermined angle with respect to the radial direction passing through the axis center (O) of the rotary shaft. In FIG. 4, an example is illustrated in which the tilting angle ($\alpha$) is approximately 4 to 10 degrees, and more specifically, 6 degrees based on the rotational angle.

For example, in the vane slot 132 according to an embodiment, a second center line (CL2), which is a longitudinal (or radial) center line of the vane slot 132, may intersect with the above-described tilting angle ($\alpha$) with respect to a first center line (CL1) thereof. In other words, the first center line (CL1) and the second center line (CL2) may respectively intersect at the axial center (or a hinge center of the vane) (O') of the hinge groove 1414. As described above, the first center line (CL1) is an imaginary line passing through the axial center (O) of the rotary shaft and the axial center (O') of the hinge groove.

In other words, about the axial center (O') of the hinge groove 1414, an outer end 1321 of the vane slot 132 is tilted to be inclined toward the suction port 131, and an inner end 1322 of the vane slot 132 is tilted to be inclined toward the discharge guide groove 133. In the following description, it will be described by defining a side disposed with the suction port as a suction side and a side disposed with the discharge guide groove as a discharge side.

Accordingly, the second center line (CL2), which is a radial center line of the vane slot 132, does not pass through an axial center (O) of the rotary shaft 30 but passes through a slightly eccentric position from the axial center (O) of the rotary shaft 30.

The tilting angle ($\alpha$) is defined as an angle at which the direction of a reaction force of the roller (i.e., roller reaction force, Fr) with respect to the vane at any rotational angle corresponds to the second center line (CL2) or an angle which becomes $\pm\beta$ (machining error) with respect to the second center line (CL2). Furthermore, the any rotational angle may be defined as a discharge start angle.

For example, the discharge start angle according to an embodiment may exist at a point at which the rotational angle is approximately 210 degrees in the compression advancing direction with respect to the first center line (CL1) or at any point within a range of 210 to 240 degrees. Accordingly, the maximum roller reaction force (Fr) is generated when the rotational angle is at the above point, and a direction in which the maximum roller reaction force (Fr) acts in a direction corresponding to the second center line or becoming $\pm\beta$. In other words, the maximum roller reaction force approximately corresponds to a length direction of the vane slot or a length direction of the vane.

The tilting angle described above may not necessarily be limited to a range of the discharge start angle. For example, the tilting angle ($\alpha$) may be defined such that the second center line (CL2) at a radial center line of the vane slot intersects the first center line (CL1) in a range of [the maximum roller reaction force direction ±30°].

As described above, when the vane slot is defined in a direction corresponding to the roller reaction force, it may be possible to reduce an increase in side pressure or side wear between the vane and the vane slot due to the roller reaction force generated during the compression of refrigerant. This reduces friction loss and reliability degradation due to an increase in side pressure or side wear between the vanes and the vane slot.

Figure 5B:
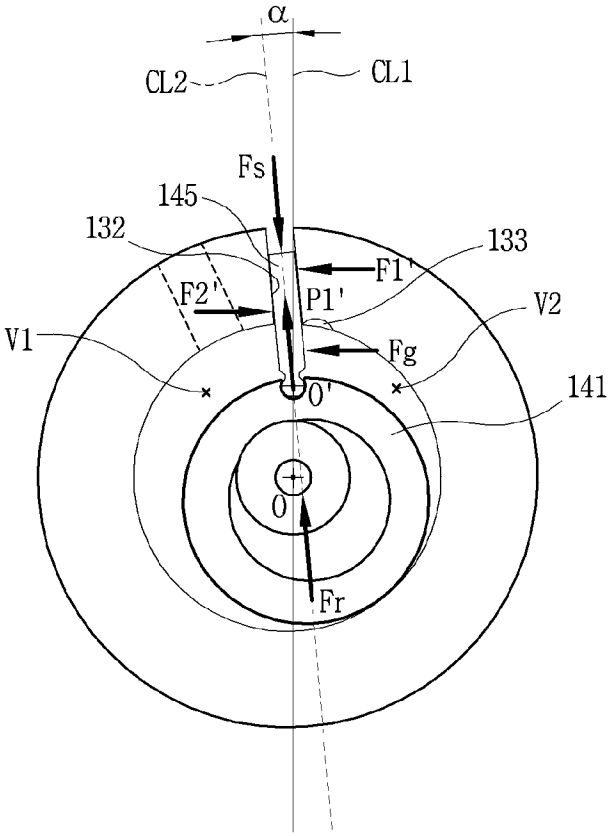
FIGS. 5A-5B illustrate plan views shown to explain the vane slot according to an embodiment in comparison with a vane slot in the related art, where
Figure 5A:
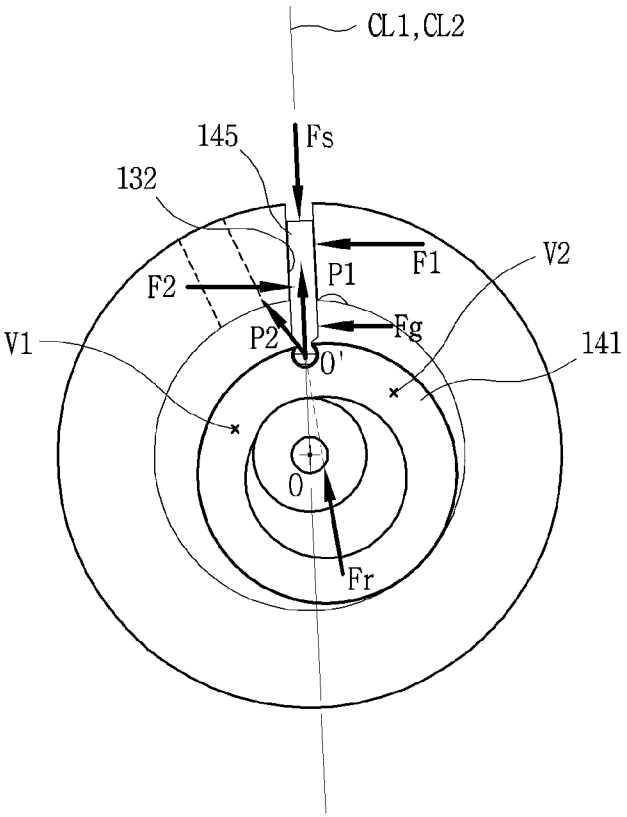

FIGS. 5A-5B illustrate plan views shown to explain the vane slot according to an embodiment in comparison with a vane slot in the related art. FIG. 5A shows an example in which the vane slot in the related art is applied, and FIG. 5B shows an example in which the vane slot according to an embodiment is applied.

First, referring to FIG. 5A, as described above, an imaginary line passing through an axial center (O) of the cylinder or an axial center (O) of the rotary shaft 30 and a hinge center of the vane 145, that is, the hinge protrusion 1452 or an axial center (O') of the hinge groove 1414 is referred to as a first center line (CL1), and a radial (or longitudinal) center line of the vane passing through the hinge center (O') of the vane 145 or a radial center line of the vane slot 132 is referred to as a second center line (CL2), the vane slot 132 in the related art is disposed at a position where the first center line (CL1) and the second center line (CL2) correspond to each other. In other words, the vane slot 132 in the related art is disposed in an approximately radial direction with respect to an axial center (O) of the cylinder or an axial center (O) of the rotary shaft. Accordingly, the vane slidably inserted into the vane slot 132 also reciprocates along the radial direction.

As described above, when the vane slot 132 is disposed in a radial direction with respect to the center (O) of the cylinder 130, a gas force (Fg) acting in a width direction of the vane 145 at a specific range of rotational angle, such as, for example, the discharge stroke as well as a roller reaction force (Fr) described above is transmitted to the vane 145 with little attenuation.

In other words, in the related art, as shown in FIG. 5A, the roller reaction force (Fr) is generated in a direction intersecting a length direction of the vane 145. Accordingly, the vane 145 generates a force (P2) acting in a direction intersecting a force (P1) acting in the length direction of the vane by the roller reaction force (Fr). Between these directional forces (P1, P2), a first force (P1) acting in the length direction of the vane is canceled by a spring force (Fs) acting from a rear side of the vane 145, but a second force (P2) acting in a direction intersecting the length direction is applied to the vane 145 without canceling. This second force (P2) is transmitted to the vane slot 132 through the vane 145.

Then, the vane 145 receiving the gas force (Fg) in a width direction is further subjected to a force at an angle slightly distorted with respect to the second imaginary line (CL2) by the roller reaction force (Fr), thereby further compressing between a side surface of the vane 145 and an inner wall surface of the vane slot 132 as the vane 145 is further distorted with respect to the vane slot 132. Then, the vane slot reaction force (F1, F2) transmitted between the vane slot 132 and the vane 145 is further increased, and in this state, an increase in side pressure or side wear on both side surfaces of the vane 145 or on both inner wall surfaces of the vane slot 132 facing them may be aggravated.

However, as shown in FIG. 5B, the vane slot 132 according to an embodiment is disposed at an angle slightly distorted by the foregoing tilting angle ($\alpha$) with respect to the axial center (O) of the cylinder 130. In other words, in the embodiment, the second center line (CL2), which is a longitudinal center line of the vane 145 (or a radial center line of the vane slot), is crossed by a predetermined tilting angle ($\alpha$) with respect to the first center line (CL1) passing through an axial center (O) of the rotary shaft 30. The second center line (CL2) is disposed in a direction corresponding to the length direction of the vane 145.

When it is viewed from a side surface of the roller reaction force (Fr), a direction of the roller reaction force (Fr) generated at the discharge start angle defined above corresponds to a length direction of the vane. Then, only a force (P1') acting in the length direction of the vane is generated at the hinge center (O'), and a force (P2) in the intersecting direction described in FIG. 5A is not generated. However, the force (P1') acting in the length direction of the vane is canceled by the spring force (Fs) acting at a rear end of the vane 145. Then, as the force acting on the vane acts only with the gas force (Fg) except the roller reaction force (Fr), the vane 145 and the vane slot 32 are weakly in contact with each other as shown in FIG. 5A.

Then, the vane slot reaction forces (F1', F2') transmitted between the vane slot 132 and the vane 145 in the embodiment are reduced as compared to the example (in the related art) shown in FIG. 5A, and an increase in side pressure or side wear on both side surfaces of the vane 145 or on both inner wall surfaces of the vane slot 132 facing them is reduced. Accordingly, as described above, the roller reaction force generated during compression of refrigerant is canceled, thereby reducing friction loss and reliability deterioration between the vane and the vane slot.

On the other hand, a hinge groove in which the hinge protrusion of the vane is rotatably inserted is disposed on the outer circumferential surface of the roller. When the vane slot is inclined by a predetermined tilting angle with respect to the axial center of the rotary shaft as in the embodiment, interference between the roller and the vane may increase during orbiting movement of the roller. Therefore, the hinge groove according to an embodiment may be defined by widening or tilting an opening surface.

Figure 6:
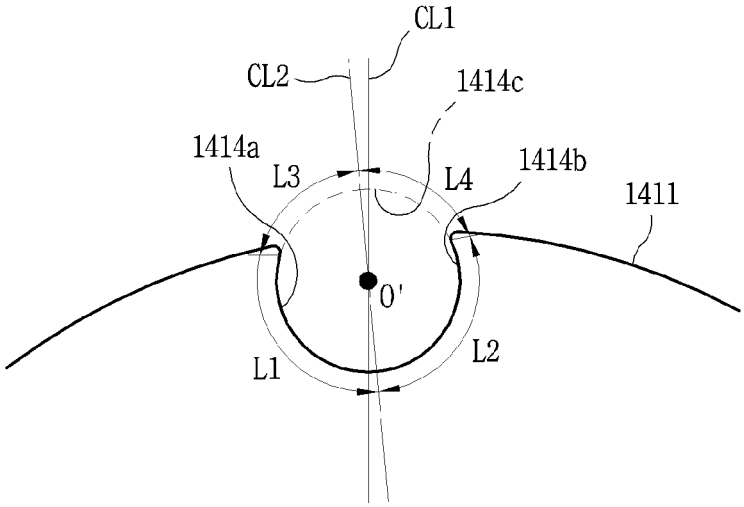
FIGS. 6 and 7 are schematic views of a hinge groove according to embodiments.
Figure 7:
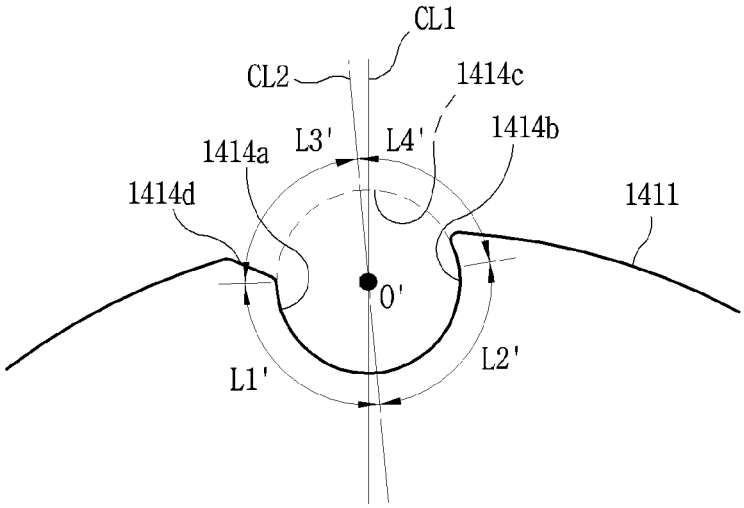

FIGS. 6 and 7 are schematic views showing embodiments of a hinge groove according to an embodiment. Referring to FIG. 6, the hinge groove 1414 according to an embodiment may be defined in an arc shape in which a portion of an outer side thereof is open. For example, in the hinge groove 1414 according to the embodiment, a first inner circumferential surface 1414*a* is disposed at a suction side with respect to the second center line (CL2), and a second inner circumferential surface 1414*b* is disposed at a discharge side. Further, an open end of the first inner circumferential surface 1414*a* and an open end of the second inner circumferential surface 1414*b* are open to extend to an outer circumferential surface of the roller 141. Therefore, an imaginary line that arbitrarily extends between the open end of the first inner circumferential surface 1414*a* and an open end of the second inner circumferential surface 1414*b* defines an opening 1414*c*.

The hinge groove 1414 according to the embodiment may be symmetrical with respect to the second center line (CL2). In other words, an arc length (L1) of the first inner circumferential surface 1414*a* and an arc length (L2) of the second inner circumferential surface 1414*b* may be the same.

Then, the arc lengths (L3, L4) of the opening 1414*c* connecting the first inner circumferential surface 1414*a* and the second inner circumferential surface 1414*b* with an imaginary line are both the same with respect to the second center line (CL2). Accordingly, an arc length of the opening 1414*c* must be long enough to prevent interference between the roller 141 and the vane 145 in view of the fact that the vane slot (or vane) is tilted by a preset or predetermined angle with respect to the first center line (CL1).

For example, the hinge groove 1414 according to the embodiment is disposed to the extent that the vane body 1451 or the interference avoiding surface 1453 does not overlap with an end of the first inner circumferential surface 1414*a* or an end of the second inner circumferential surface 1414*b* when the vane 145 rotates about the roller 141. Accordingly, while both sides of the hinge groove 1414 are symmetrical with respect to the second center line (CL2), a side surface of the vane 145 does not interfere with an open end of the hinge groove 1414 of the roller 141. Thus, when the roller 141 performs an orbiting movement at a predetermined angle with respect to the axial center (O) according to a rotational angle of the rotary shaft 30, the roller 141 efficiently performs an orbiting movement to compress refrigerant.

Referring to FIG. 7, the hinge groove 1414 may be asymmetrical with respect to the second center line (CL2). In other words, an arc length (L1') of the first inner circumferential surface may be smaller than an arc length (L2') of the second inner circumferential surface.

In this case, an extension surface 1414*d* connected to the outer circumferential surface of the roller body 1411 may be disposed at an end portion of the first inner circumferential surface 1414*a*. The extension surface 1414*d* may be defined as an inclined surface or a curved surface so as to extend in a direction away from the vane 145 toward the outer circumferential direction of the roller body 1411. In FIG. 7, it is shown as an inclined surface.

Accordingly, the hinge groove 1414 has a wider opening surface at a side of the first inner circumferential surface 1414*a* with respect to the second center line (CL2). Thus, the arc length (L1') of the first inner circumferential surface 1414*a* is shorter than the arc length (L2') of the second inner circumferential surface 1414*b* as the vane slot 132 is distorted toward the suction side. For the arc lengths (L3, L4') of the opening surface 1414*c* connecting the first inner circumferential surface 1414*a* and the second inner circumferential surface 1414*b* with an imaginary line, the arc length (L3') of the suction side opening surface is larger than the art length (L4') of the discharge side opening surface with respect to the second center line (CL2).

Accordingly, an end of the first inner circumferential surface 1414*a* including the extension surface 1414*d* is located further away from the vane 145 than an end of the second inner circumferential surface 1414*b*. When the roller 141 performs an orbiting movement, the roller 141 and the vane 145 may be prevented from interfering with each other.

Although not illustrated in the drawings, the extension surface may be disposed on the first inner circumferential surface 1414*a* and the second inner circumferential surface 1414*b*, respectively. In this case, the first extension surface extending from the first inner circumferential surface 1414*a* may extend in a direction opposite to the second extension surface extending from the second inner circumferential surface 1414*b*.

In this case, a length of the first extension surface may be larger than a length of the second extension surface. Accordingly, as described above, the arc length (L1) of the first inner circumferential surface 1414*a* is shorter as the vane slot 132 is distorted toward the suction side, and thus, the roller 141 and vane 145 may be prevented from interfering with each other when the roller 141 performs an orbiting movement.

Figure 8:
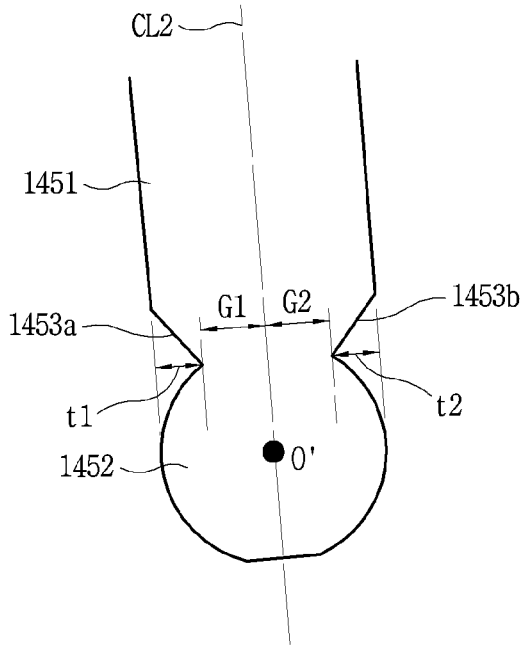
FIGS. 8 and 9 are schematic views of a vane according to embodiments.
Figure 9:
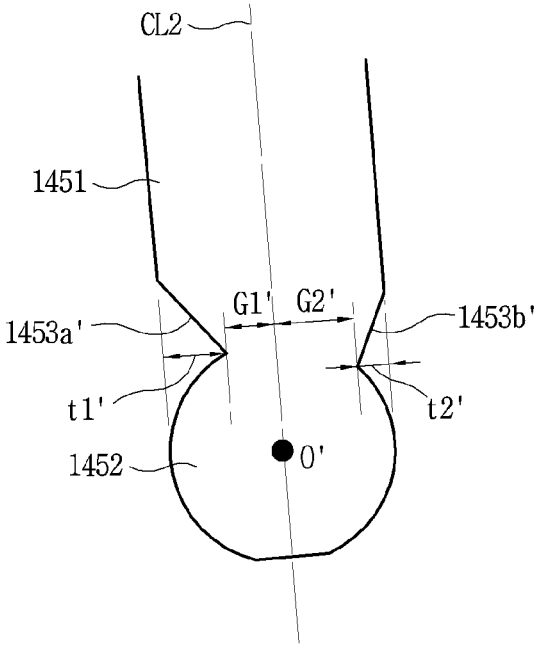

The vane 145 may be symmetrical to each other or asymmetrical to each other in both width directions with respect to the second center line (CL2). FIGS. 8 and 9 are schematic views of a vane according to embodiments.

Referring to FIG. 8, the vane body 1451, the hinge protrusion 1452, and the interference avoiding surface 1453 may have a same size and shape in both width directions with respect to the second center line (CL2). For example, both interference avoiding surfaces 1453 may be defined in a wedge cross-sectional shape, respectively. In other words, when the suction side interference avoiding surface is referred to as a first interference avoiding surface 1453*a* and the discharge side interference avoiding surface as a second interference avoiding surface 1453*b*, the first interference avoiding surface 1453*a* and the second interference avoiding surface 1453*b* may be defined in a same size and shape.

Accordingly, the first interference avoiding surface 1453*a* and the second interference avoiding surface 1453*b* may be disposed at positions spaced apart from the second center line (CL2) by a same distance. Then, a first thickness (G1) defined as a gap between the first interference avoiding surface 1453*a* and the second center line (CL2) and a second thickness (G2) defined as a gap between the second interference avoiding surface 1453*b* and the second center line (CL2) may be the same, and a first depth (t1) of the first interference avoiding surface 1453*a* and a second depth (t2) of the second interference avoiding surface 1453*b* may be the same.

When the vane is defined in a symmetrical shape as described above, the vane may be easily processed. However, in this case, considering that the vane slot 132 is disposed in a direction corresponding to the direction of the roller reaction force (Fr), the hinge groove 1414 may be defined such that the first inner circumferential surface 1414*a* is smaller than the outer circumferential surface 1414*b* as shown in FIG. 7.

Referring to FIG. 9, at least a portion of the vane body 1451, the hinge protrusion 1452, and the interference avoiding surface 1453 may be defined in different sizes and shapes in both width directions with respect to the second center line (CL2). For example, a first thickness (G1') defined as a gap between the first interference avoiding surface 1453*a*' and the second center line (CL2) may be smaller than a second thickness (G2') defined as a gap between the second interference avoiding surface 1453*b*' and the second center line (CL2). Thus, a neck thickness from the second center line (CL2) to the first interference avoiding surface 1453*a*' may be smaller than a neck thickness from the second center line (CL2) to the second interference avoiding surface 1453*b*'.

Accordingly, a first depth (t1') of the first interference avoiding surface 1453*a*' may be larger than a second depth (t2') of the second interference avoiding surface 1453*b*'. With this structure, even when the vane (or vane slot) 145 is provided at a position rotated by a preset or predetermined tilting angle ($\alpha$) with respect to the first center line (CL1), an end of the first inner circumferential surface 1414*a* of the roller 141 may be prevented from interfering with the first interference avoiding surface 1453*a*' of the vane 145 during relative movement between the roller 141 and the vane 145.

On the other hand, as described above, when the vane 145 is defined in an asymmetrical shape, the roller 141 may be defined in a symmetrical shape. Therefore, the roller 141 may be easily processed. However, even when the vane is defined in an asymmetrical shape, the vane body 1451 and the hinge protrusion 1452 may be symmetrical to each other with respect to the second center line (CL2).

Although not shown in the drawing, the first interference avoiding surface 1453*a* may be defined in a wedge cross-sectional shape, and the second interference avoiding surface 1453*b* may be defined in a curved shape. Also, in this case, a depth of the first interference avoiding surface 1453*a* facing an end of the first inner circumferential surface 1414*a* may be larger than a depth of the second interference avoiding surface 1453*b*.

When the vane slot is disposed in the same direction as the roller reaction force in the rotary compressor according to embodiments, it has the following effects.

Figure 10:
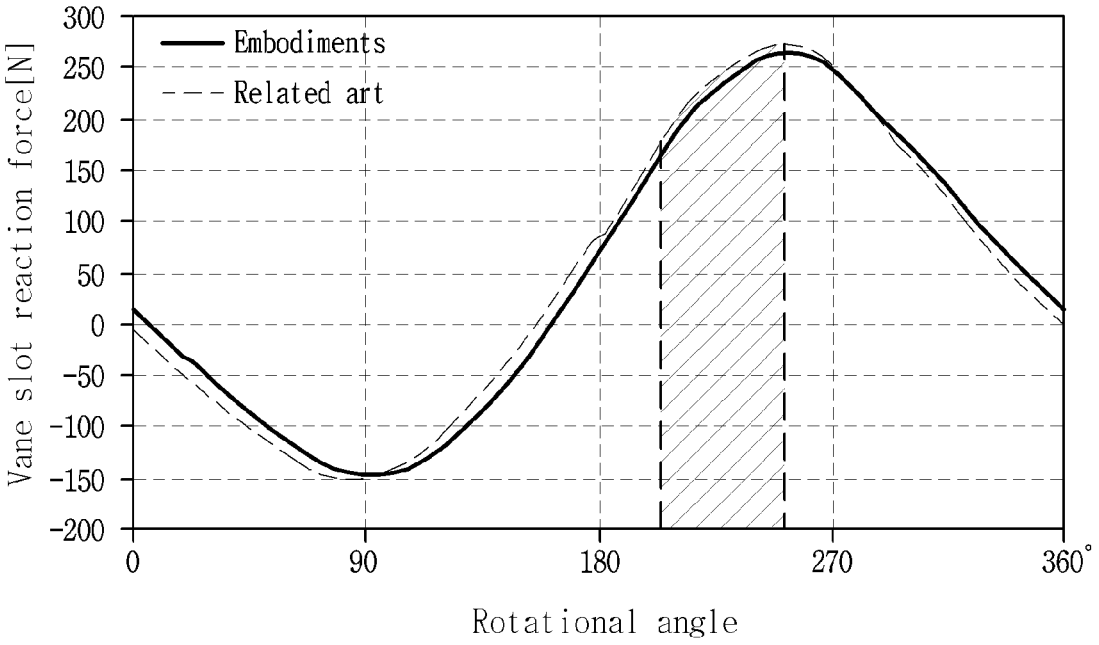
FIG. 10 is a graph showing reaction forces in a vane slot according to a slope of the vane slot in a rotary compressor according to an embodiment in comparison with that according to the related art.

FIG. 10 is a graph showing reaction forces in a vane slot according to a slope of the vane slot in a rotary compressor according to an embodiment in comparison with that according to the related art. In the graph, the dotted line is an example in which a longitudinal center line of the vane slot is disposed to pass through the foregoing first center line, and the solid line is an example in which the longitudinal center line of the vane slot is inclined by a rotational angle of approximately 6° with respect to the foregoing first center line. For convenience of description, it will be described by defining the dotted line as the related art, and defining the solid line as the embodiments.

Referring to FIG. 10, it may be seen that a reaction force in the vane slot (hereinafter, referred to as a "vane slot reaction force") in embodiments is reduced compared to the related art. In particular, when viewed around 210° which is a time when discharge is started, it may be seen that the vane slot reaction force in the related art is 250 to 270 N with respect to the same angle, whereas the vane slot reaction force of embodiments is reduced to about 240 to 260 N. With this structure, it may be seen that the vane slot reaction force in embodiments is reduced by approximately 3% compared to that in the related art.

In this manner, in a hinge vane type rotary compressor according to embodiments, a vane slot may be located at the same line as a direction in which a roller reaction force acts to cancel the roller reaction force, thereby suppressing an increase in side pressure or suppressing side wear between a vane and a vane slot into which the vane is inserted. Further, according to embodiments, a vane chamber may be disposed to cancel a roller reaction force at a discharge start angle or around the discharge start angle, thereby effectively suppressing an increase in side pressure or suppressing side wear between the vane and the vane slot.

In addition, according to embodiments, an opening surface of the hinge groove into which a hinge protrusion of the vane is inserted may be widened or one interference avoiding surface of the vane may be widened, thereby suppressing interference between the vane and the roller. With this structure, a behavior of the roller or vane may be stabilized, thereby effectively suppressing an increase in side pressure or suppressing side wear between the vane and the vane slot.

Moreover, according to embodiments, the vane may be symmetrically disposed about a longitudinal center line of the vane while being tilted about the axial center of the rotary shaft, thereby canceling a roller reaction force transmitted to the vane, thereby suppressing an increase in side pressure between the vane and the vane slot or suppressing side wear while at the same time facilitating processing of the vane.

On the other hand, in a hinge vane type rotary compressor according to embodiments, as the roller and the vane are coupled to each other, a specific portion of the roller may collide with or press against a thrust surface of the main plate or a thrust surface of the sub plate. In particular, a discharge side of the hinge groove at the discharge chamber may be in contact with high-pressure refrigerant to generate a greater thermal expansion than the other portion, thereby increasing friction loss or an amount of wear against the thrust surface while increasing an axial height of the thermally expanded roller. As a result, in embodiments disclosed herein, the wear avoiding portions or dimple portions for storing oil may be disposed on both axial end surfaces of the roller or axial side surfaces of the main plate facing the roller or axial side surfaces of the sub plate.

Figure 11:
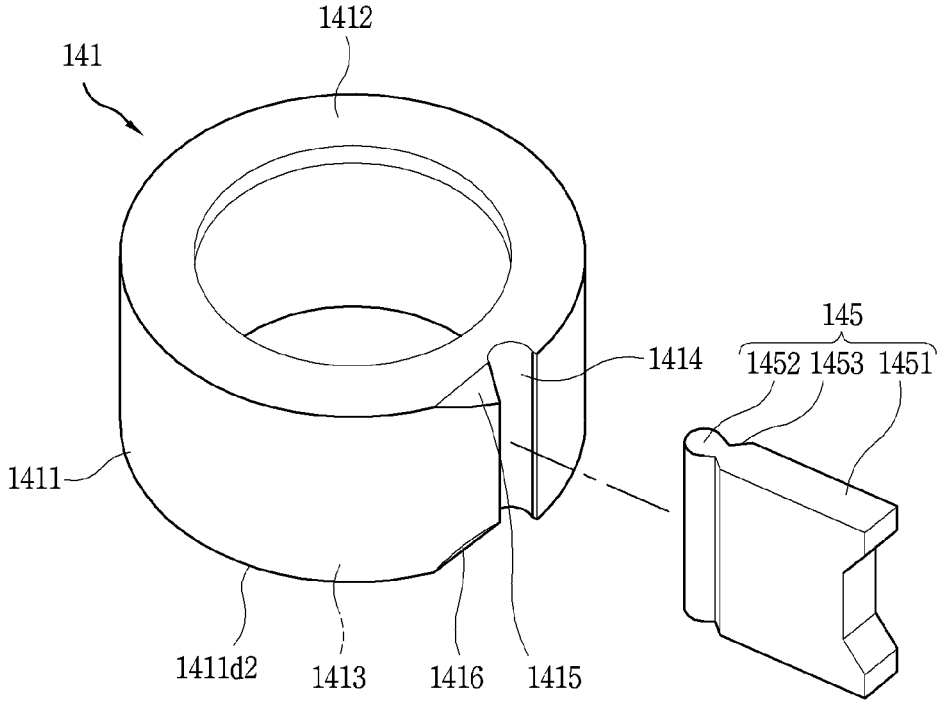
FIGS. 11 and 12 are perspective views and cross-sectional views showing a roller having a wear avoiding portion and a dimple portion according to embodiments, where
Figure 12:
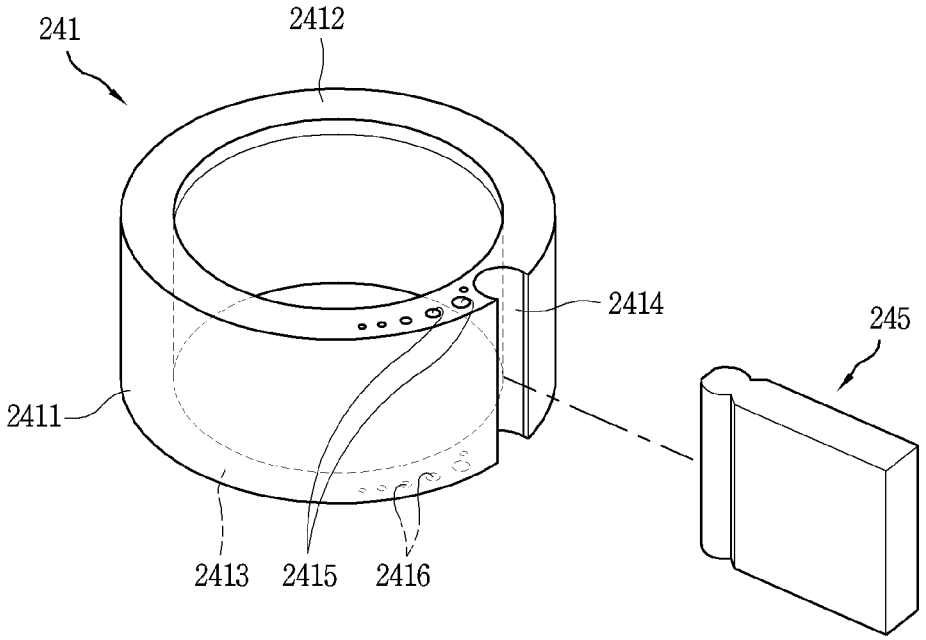

FIGS. 11 and 12 are perspective views and cross-sectional views showing a roller having a wear avoiding portion and a dimple portion according to embodiments. FIG. 11 shows an embodiment in which the wear avoiding portion is disposed, and FIG. 12 shows an embodiment in which the dimple portion is disposed.

Referring to FIG. 11, the wear avoiding portion 1415, 1416 may be disposed on at least one of the first sealing surface 1412 or the second sealing surface 1413. More precisely, the wear avoiding portions 1415, 1416 may have a preset or predetermined depth at an outer edge where the first sealing surface 1412 or the second sealing surface 1413 and the outer circumferential surface 1411*b* are connected to each other.

For example, referring back to FIG. 11, the wear avoiding portion 1415, 1416 according to embodiments may be disposed at a portion defining a discharge chamber (V) or at a position closest to the portion defining the discharge chamber (V) on the sealing surface of the roller 141. Based on the hinge groove 1414 to which the vane 145 is coupled, the vane 145 may include the hinge groove 1414 or be disposed around the hinge groove 1414.

The wear avoiding portions 1415, 1416 may be disposed in an inclined manner, as shown in FIG. 11, or may be disposed in a stepped manner. When the wear avoiding portions 1415, 1416 are disposed in a stepped manner as compared to being disposed in an inclined manner, a volume of the wear avoiding portions 1415, 1416 may be further increased.

Even when the roller 141 is thermally expanded, it may be possible to suppress an increase in the axial height of the roller 141 due to the thermal expansion amount by the wear avoiding portions 1415, 1416. With this structure, wear between the roller 141 and the main plate 110 or the sub plate 120 may be reduced.

In addition, although not shown in the drawings, the wear avoiding portions 1415, 1416 may be disposed at both circumferential sides with respect to the hinge groove therebetween. In this case, a wear avoiding portion disposed at a suction chamber side may be defined as a suction side wear avoiding portion, and a wear avoiding portion disposed at a discharge chamber side as the discharge side wear avoiding portion.

The suction side wear avoiding portion and the discharge side wear avoiding portion may be defined in a same shape, or may be defined in different shapes in consideration of a difference in thermal expansion amount. When both the wear avoiding portions are defined in the same shape, it may be possible to facilitate the process, and when defined in different shapes, it may be possible to compensate for a difference in thermal expansion rate.

Referring to FIG. 12, dimple portions or dimples 2415, 2416 may be disposed in place of the wear avoiding portions 1415, 1416 described above. The dimple portions 2415, 2416 according to the embodiment may be disposed at a similar position as compared with the wear avoiding portions 1415, 1416 of the previous embodiment, but may be disposed at an inner side than the wear avoiding portions 1415, 1416.

For example, the dimple portions 2415, 2416 according to the embodiment may be disposed in a range of the first sealing surface 2412 and the second sealing surface 2413. This is because the dimple portions 2415, 2416 according to embodiments store oil therein to increase lubricity between the sealing surfaces 2412, 2413 of the roller 241 and thrust surfaces (not shown) of both plates 110, 120 facing them.

The dimple portions 2415, 2416 according to embodiments may include at least one dimple. As illustrated in FIG. 12, a plurality of dimples may be disposed along a circumferential direction at a discharge side with respect to the hinge groove 2414 as in the wear avoiding portion of the previous embodiment. Also, in this case, a volume of the dimple closet to the hinge groove may be larger than a volume of the dimple away from the hinge groove 2414.

Although not shown in the drawing, the dimple may be one dimple. In this case, the one dimple may extend lengthwise in a circumferential direction, and a side closer to the hinge groove may be wider or deeper than an opposite side thereof.

In addition, although not shown in the drawing, the dimples according to embodiments may be disposed on the suction side and the discharge side, respectively, with the hinge groove interposed therebetween, and shapes of the dimples may be the same or different. When shapes of the dimples are different, the dimple located at the discharge side may have a larger volume.

With this structure, it may be possible to suppress or reduce impact or compression between the roller and the plate, which may be caused by tilting and thermal expansion of the roller generated during operation of the compressor in a hinge vane type. Further, it may be possible to suppress excessive contact between contact surfaces of the roller and plate so as to reduce frictional loss, thereby increasing compressor performance as well as reducing wear of the rollers or plates so as to improve reliability.

In the above-described embodiments, the roller and the vane have been described with reference to an example applied to a vane roller type in which the roller and the vane are hinge-coupled to each other or formed as a single body, but embodiments may also be applicable to a rolling piston type in which the vane is slidably in contact with an outer circumferential surface of the roller. In this case, however, as the rolling piston is not constrained by the vane, the wear avoiding portions may be respectively disposed at an axial side surface of the main plate or the sub plate facing both axial ends of the rolling piston.

Further, the above-described embodiments have been described with reference to an example in which the roller and the vane are rotatably coupled to each other, but the wear avoiding portion may also be similarly applicable to a case where the roller and the vane are formed as a single body. In addition, the above embodiments have been described with reference to an example of one cylinder, but the wear avoiding portion may also be similarly applicable to a case having a plurality of cylinders.

In a rotary compressor according to embodiments disclosed herein, a vane slot may be located at a same line as a direction in which a roller reaction force acts in a hinge vane type to cancel the roller reaction force, thereby suppressing an increase in side pressure or suppressing side wear between a vane and a vane slot into which the vane is inserted. Further, according to embodiments disclosed herein, a vane chamber may be disposed to cancel a roller reaction force at a discharge start angle or around the discharge start angle, thereby effectively suppressing an increase in side pressure or suppressing side wear between the vane and the vane slot.

According to embodiments disclosed herein, an opening surface of the hinge groove into which a hinge protrusion of the vane is inserted may be wide or one interference avoiding surface of the vane may be wide, thereby suppressing interference between the vane and the roller. With this structure, a behavior of the roller or vane may be stabilized, thereby effectively suppressing an increase in side pressure or suppressing side wear between the vane and the vane slot. Moreover, the vane may be symmetrically disposed about a longitudinal center line of the vane while being tilted about an axial center of the rotary shaft, thereby canceling a roller reaction force transmitted to the vane, thereby suppressing an increase in side pressure between the vane and the vane slot or suppressing side wear while at the same time facilitating processing of the vane.

On the other hand, according to embodiments disclosed herein, as a roller reaction force may be further generated when using a high-pressure refrigerant, such as R32, the high-pressure refrigerant may be usefully applicable to a hinge vane type rotary compressor.

Embodiments disclosed herein provide a rotary compressor capable of suppressing an increase in side pressure or suppressing side wear between a vane and a vane slot into which the vane is inserted in a hinge vane type. Embodiments disclosed herein also provide a rotary compressor capable of canceling a roller reaction force in a hinge vane type.

Embodiments disclosed herein provide a rotary compressor capable of canceling a roller reaction force around a discharge start angle in a hinge vane type. Further, embodiments disclosed herein provide a rotary compressor capable of easily canceling a roller reaction force in a hinge vane type.

Furthermore, embodiments disclosed herein provide a rotary compressor capable of canceling a roller reaction force by adjusting a direction of the vane or vane slot in a hinge vane type. Moreover, embodiments disclosed herein provide a rotary compressor capable of preventing interference between the vane and the roller while canceling a roller reaction force in a hinge vane type. In addition, embodiments disclosed herein provide a rotary compressor capable of easily processing the vane while canceling a roller reaction force in a hinge vane type.

Embodiments disclosed herein provide a rotary compressor provided with a hinge vane, wherein a direction in which the roller reaction force acts at the discharge start angle and a length direction of the vane are the same. Embodiments disclosed herein provide a rotary compressor, wherein a hinge protrusion of the vane is rotatably inserted into a hinge groove of the roller, and a roller reaction force acting on a contact point between the roller and the vane is canceled. In addition, embodiments disclosed herein provide a rotary compressor, wherein a plate is hinge-coupled to an outer circumferential surface of the annular roller, the plate is slidably inserted into a cylinder, and a longitudinal center line of the plate does not pass through an axial center line of the rotary shaft.

Embodiments disclosed herein provide a rotary compressor that may include a rotary shaft; a plurality of plates that supports the rotary shaft; a cylinder provided between the plurality of plates to define a compression space, and provided with a vane slot; a roller slidably coupled to the rotary shaft inside of the cylinder, and disposed with a hinge groove on an outer circumferential surface thereof; and a vane, one or a first end of which is slidably coupled to the vane slot of the cylinder, and the other or a second end of which is rotatably coupled to the hinge groove of the roller. When an imaginary line passing through an axial center of the rotary shaft and a hinge center of the vane is referred to as a first center line, and a radial center line of the vane slot passing through the hinge center of the vane is referred to as a second center line, the vane slot may be disposed such that the second center line is intersected by a preset or predetermined tilting angle with respect to the first center line.

The vane slot may be disposed such that the second center line has an angle of ±30° with respect to a maximum roller reaction force direction transmitted to the vane. Further, the vane slot may be disposed such that the second center line corresponds to a maximum roller reaction force direction transmitted to the vane.

The compression space may be divided into a suction side and a discharge side with the vane interposed therebetween. An inner end of the vane slot may face the discharge side, and an outer end of the vane slot may be tilted with respect to the first center line to face the suction side.

The vane and the hinge groove may be disposed to be symmetrical with respect to the second center line. At least one of the vane or the hinge groove may be asymmetrical with respect to the second center line.

The hinge groove may be disposed with a first inner circumferential surface located on the suction side and a second inner circumferential surface located on the discharge side with respect to the second center line. An arc length of the first inner circumferential surface may be smaller than that of the second inner circumferential surface.

A first extension surface extending in a direction away from the vane may be disposed at an end of the first inner circumferential surface. A first extension surface extending in a direction away from the vane may be disposed at an end of the first inner circumferential surface, and a second extension surface extending in an opposite direction to the first extension surface may be disposed at an end of the second inner circumferential surface. A length of the first extension surface may be disposed to be larger than that of the second extension surface.

The vane may include a vane body slidably provided in the vane slot; a hinge protrusion rotatably coupled to the hinge groove; and an interference avoiding surface disposed to extend between the vane body and the hinge protrusion to be recessed. Both sides of the interference avoiding surface may be asymmetrical with respect to the second center line.

When the suction side is referred to as a first interference avoiding surface and the discharge side is referred to as a second interference avoiding surface with respect to the second center line, a depth of the first interference avoiding surface may be larger than that of the second interference avoiding surface. A wear avoiding portion having a preset or predetermined depth may be disposed on at least one end surface between both end surfaces of the roller facing the plate, and the wear avoiding portion may be defined by chamfering an outer circumferential edge of the roller around the hinge groove.

A dimple portion or dimple having a preset or predetermined depth may be disposed on at least one end surface between both end surfaces of the roller facing the plate. The dimple portion may be disposed between an inner circumferential edge and an outer circumferential edge of the roller around the hinge groove.

Embodiments disclosed herein provide a rotary compressor that include a rotary shaft; a plurality of plates that supports the rotary shaft; a cylinder provided between the plurality of plates to define a compression space, and provided with a vane slot; a roller coupled to the rotary shaft; and a vane, one or a first end of which is slidably coupled to the vane slot of the cylinder, and the other or a second end of which is coupled to the roller. One or a first circumferential side of which may define a space having a suction pressure, and the other or a second circumferential side of which may define a space having a discharge pressure. The vane may be disposed such that a radial center line thereof passes through a position spaced apart from an axial center of the rotary shaft.

When an imaginary line passing through an axial center of the rotary shaft and a hinge center of the vane is referred to as a first center line, and a radial center line of the vane passing through the hinge center of the vane is referred to as a second center line, the vane may be disposed such that a maximum roller reaction force direction transmitted to the vane and the second center line correspond to each other. The vane may be symmetrical with respect to the second center line.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A rotary compressor, comprising:

a rotary shaft;

a plurality of plates that supports the rotary shaft;

a cylinder provided between the plurality of plates to define a compression space, and provided with a vane slot;

a roller slidably coupled to the rotary shaft inside of the cylinder, and disposed with a hinge groove on an outer circumferential surface of the roller; and a vane, a first end of which is slidably coupled to the vane slot of the cylinder, and a second end of which is rotatably coupled to the hinge groove of the roller, wherein when an imaginary line passing through an axial center of the rotary shaft and a hinge center of the vane is a first center line, and a radial center line of the vane slot passing through the hinge center of the vane is a second center line, the vane slot is disposed such that the second center line is intersected by a predetermined tilting angle with respect to the first center line, wherein a wear avoiding portion or a dimple having a predetermined depth is disposed on at least one end surface of end surfaces of the roller facing the plurality of plates, and wherein the wear avoiding portion is defined by chamfering an outer circumferential edge of the roller adjacent the hinge groove, and the dimple is disposed between an inner circumferential edge and an outer circumferential edge of the roller adjacent the hinge groove.

2. The rotary compressor of claim 1, wherein the vane slot is disposed such that the second center line has an angle of ±30° with respect to a maximum roller reaction force direction transmitted to the vane.

3. The rotary compressor of claim 2, wherein the vane slot is disposed such that the second center line corresponds to the maximum roller reaction force direction transmitted to the vane.

4. The rotary compressor of claim 1, wherein the compression space is divided into a suction side and a discharge side with the vane interposed therebetween, and wherein an inner end of the vane slot faces the discharge side, and an outer end of the vane slot is tilted with respect to the first center line to face the suction side.

5. The rotary compressor of claim 4, wherein the vane and the hinge groove are symmetrical with respect to the second center line.

6. The rotary compressor of claim 4, wherein at least one of the vane or the hinge groove is asymmetrical with respect to the second center line.

7. The rotary compressor of claim 6, wherein a first inner circumferential surface of the hinge groove is located on the suction side and a second inner circumferential surface of the hinge groove is located on the discharge side with respect to the second center line, and wherein an arc length of the first inner circumferential surface is smaller than an arc length of the second inner circumferential surface.

8. The rotary compressor of claim 7, wherein a first extension surface that extends in a direction away from the vane is disposed at an end of the first inner circumferential surface.

9. The rotary compressor of claim 7, wherein a first extension surface that extends in a direction away from the vane is disposed at an end of the first inner circumferential surface, and a second extension surface that extends in an opposite direction to the first extension surface is disposed at an end of the second inner circumferential surface, and wherein a length of the first extension surface is larger than a length of the second extension surface.

10. The rotary compressor of claim 6, wherein the vane comprises:

a vane body slidably provided in the vane slot;

a hinge protrusion rotatably coupled to the hinge groove; and an interference avoiding surface that extends between the vane body and the hinge protrusion and is recessed, and wherein sides of the interference avoiding surface are asymmetrical with respect to the second center line.

11. The rotary compressor of claim 10, wherein when a first interference avoiding surface is on the suction side and a second interference avoiding surface is on the discharge side with respect to the second center line, a depth of the first interference avoiding surface is larger than a depth of the second interference avoiding surface.

12. A rotary compressor, comprising:

a rotary shaft;

a plurality of plates that supports the rotary shaft;

a cylinder provided between the plurality of plates to define a compression space, and provided with a vane slot;

a roller coupled to the rotary shaft; and a vane, a first end of which is slidably coupled to the vane slot of the cylinder, and a second end of which is coupled to the roller, wherein a first circumferential side of the vane defines a space having a suction pressure, and a second circumferential side of the vane defines a space having a discharge pressure, wherein the vane is disposed such that a radial center line of the vane passes through a position spaced apart from an axial center of the rotary shaft, wherein a first inner circumferential surface of the hinge groove is located on a suction side and a second inner circumferential surface of the hinge groove is located on a discharge side with respect to the radial center line of the vane, wherein an arc length of the first inner circumferential surface is smaller than an arc length of the second inner circumferential surface, wherein a first extension surface that extends in a direction away from the vane is disposed at an end of the first inner circumferential surface, and a second extension surface that extends in an opposite direction to the first extension surface is disposed at an end of the second inner circumferential surface, and wherein a length of the first extension surface is larger than a length of the second extension surface.

13. The rotary compressor of claim 12, wherein when an imaginary line passing through the axial center of the rotary shaft and a hinge center of the vane is a first center line, and the radial center line of the vane passing through the hinge center of the vane is a second center line, the vane is disposed such that a maximum roller reaction force direction transmitted to the vane and the second center line correspond to each other.

14. The rotary compressor of claim 13, wherein the vane is symmetrical with respect to the second center line.

15. A rotary compressor, comprising:

a rotary shaft;

a plurality of plates that supports the rotary shaft;

a cylinder provided between the plurality of plates to define a compression space, and provided with a vane slot;

a roller slidably coupled to the rotary shaft inside of the cylinder, and disposed with a hinge groove on an outer circumferential surface of the roller; and a vane slidably coupled to the vane slot of the cylinder and rotatably coupled to the hinge groove of the roller, wherein a radial center line of the vane slot is tilted with respect to an imaginary line passing through an axial center of the rotary shaft and a hinge center of the vane, wherein a first inner circumferential surface of the hinge groove is located on a suction side and a second inner circumferential surface of the hinge groove is located on a discharge side with respect to the radial center line of the vane slot, wherein an arc length of the first inner circumferential surface is smaller than an arc length of the second inner circumferential surface, wherein the vane comprises:

a vane body slidably provided in the vane slot;

a hinge protrusion rotatably coupled to the hinge groove; and an interference avoiding surface that extends between the vane body and the hinge protrusion and is recessed, and wherein sides of the interference avoiding surface are asymmetrical with respect to the radial center line.

16. The rotary compressor of claim 15, wherein the radial center line of the vane slot is tilted by an angle of ±30° with respect to the imaginary line.

17. The rotary compressor of claim 16, wherein the imaginary line corresponds to a maximum roller reaction force direction transmitted to the vane.

18. The rotary compressor of claim 15, wherein the compression space is divided into a suction side and a discharge side with the vane interposed therebetween, and wherein an inner end of the vane slot faces the discharge side, and an outer end of the vane slot is tilted with to face the suction side.

* * * * *